US008297603B2

(12) United States Patent
Imaizumi et al.

(10) Patent No.: US 8,297,603 B2
(45) Date of Patent: Oct. 30, 2012

(54) SPRING RETAINER AND SPRING SYSTEM

(75) Inventors: Hironobu Imaizumi, Aikoh-gun (JP); Noritoshi Takamura, Aikoh-gun (JP)

(73) Assignee: NHK Spring Co., Ltd., Kanagawa (JP)

( * ) Notice: Subject to any disclaimer, the term of this patent is extended or adjusted under 35 U.S.C. 154(b) by 0 days.

(21) Appl. No.: 13/057,444

(22) PCT Filed: Aug. 3, 2009

(86) PCT No.: PCT/JP2009/003690
§ 371 (c)(1),
(2), (4) Date: Feb. 3, 2011

(87) PCT Pub. No.: WO2010/016227
PCT Pub. Date: Feb. 11, 2010

(65) Prior Publication Data

US 2011/0140327 A1 Jun. 16, 2011

(30) Foreign Application Priority Data

Aug. 4, 2008 (JP) ..... P2008-201071

(51) Int. Cl.
*F16F 1/06* (2006.01)

(52) U.S. Cl. ..... 267/174; 123/90.67

(58) Field of Classification Search ..... 267/174; 123/90.67; 29/215
See application file for complete search history.

(56) References Cited

U.S. PATENT DOCUMENTS

| | | | | |
|---|---|---|---|---|
| 3,021,593 | A * | 2/1962 | Cousino | 29/417 |
| 4,230,491 | A * | 10/1980 | Behnke | 75/243 |
| 4,432,311 | A * | 2/1984 | Holtzberg et al. | 123/90.67 |
| 4,665,869 | A * | 5/1987 | Hinz et al. | 123/90.67 |
| 4,989,556 | A * | 2/1991 | Shiina et al. | 123/90.67 |
| 5,381,765 | A * | 1/1995 | Rhodes | 123/90.67 |
| 6,341,588 | B2 * | 1/2002 | Kobayashi et al. | 123/90.67 |
| 6,371,063 | B2 | 4/2002 | Oyama et al. | |
| 6,966,539 | B2 * | 11/2005 | Ucman | 251/337 |
| 2001/0042530 | A1 * | 11/2001 | Kobayashi et al. | 123/90.67 |
| 2001/0047784 | A1 * | 12/2001 | Kobayashi et al. | 123/90.67 |
| 2002/0035979 | A1 * | 3/2002 | Kobayashi et al. | 123/90.67 |
| 2009/0008846 | A1 * | 1/2009 | Yamakawa et al. | 267/170 |
| 2010/0001224 | A1 * | 1/2010 | Edgar | 251/337 |

FOREIGN PATENT DOCUMENTS

| | | |
|---|---|---|
| JP | 62-243907 | 10/1987 |
| JP | 62-291409 | 12/1987 |
| JP | 6-246387 | 9/1994 |
| JP | 6-307212 | 11/1994 |
| JP | 7-063020 | 3/1995 |
| JP | 8-090139 | 4/1996 |

(Continued)

*Primary Examiner* — Robert A Siconolfi
*Assistant Examiner* — James Hsiao
(74) *Attorney, Agent, or Firm* — Jordan and Hamburg LLP

(57) ABSTRACT

A spring retainer is made from an iron-based material to improve the strength and abrasion resistance of the spring retainer and reduce the thickness and weight thereof. The spring retainer includes a retainer body having a tapered support hole to be supported with a valve stem and a flange-like spring seat circumferentially formed on a periphery at a first side of the retainer body to receive and support a valve spring. The retainer body and spring seat are integrally formed from resilient steel with grain flows continuously formed from the retainer body to the spring seat.

7 Claims, 7 Drawing Sheets

FOREIGN PATENT DOCUMENTS

| | | |
|---|---|---|
| JP | 9-329008 | 12/1997 |
| JP | 2000-161029 | 6/2000 |
| JP | 2002-038912 | 2/2002 |
| JP | 2002-363773 | 12/2002 |
| JP | 2005-000960 | 1/2005 |
| JP | 2006-125289 | 5/2006 |

* cited by examiner

[Fig. 1]
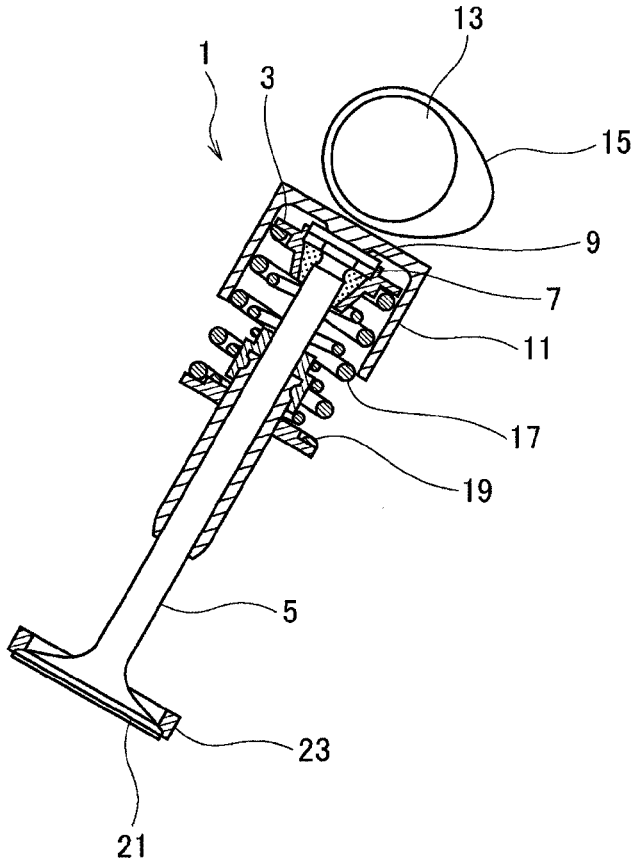
[Fig. 2]
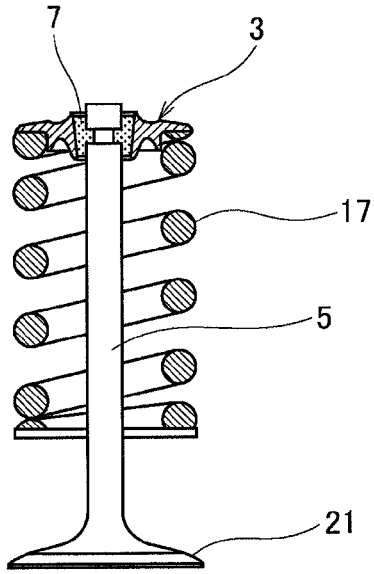

[Fig. 3]
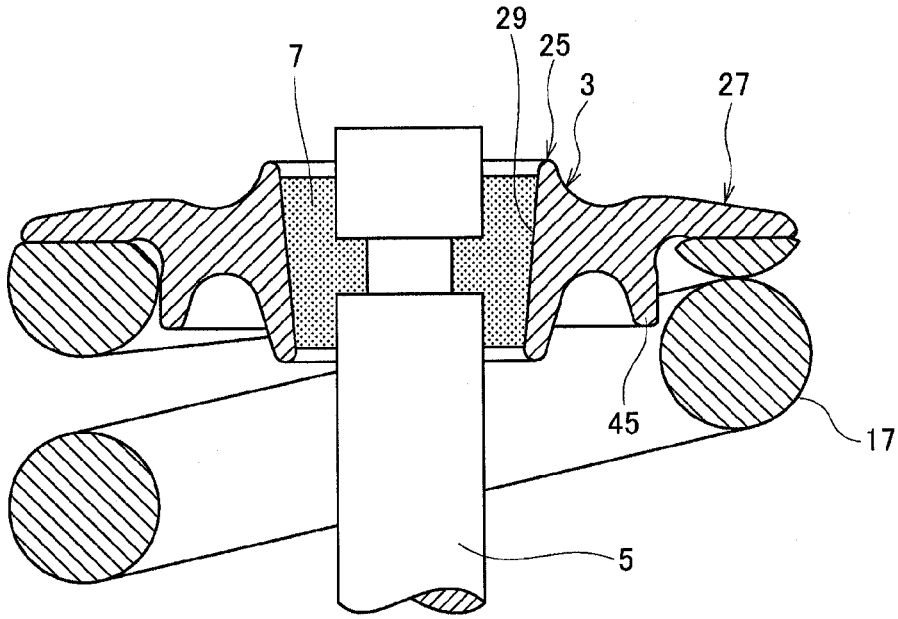
[Fig. 4]
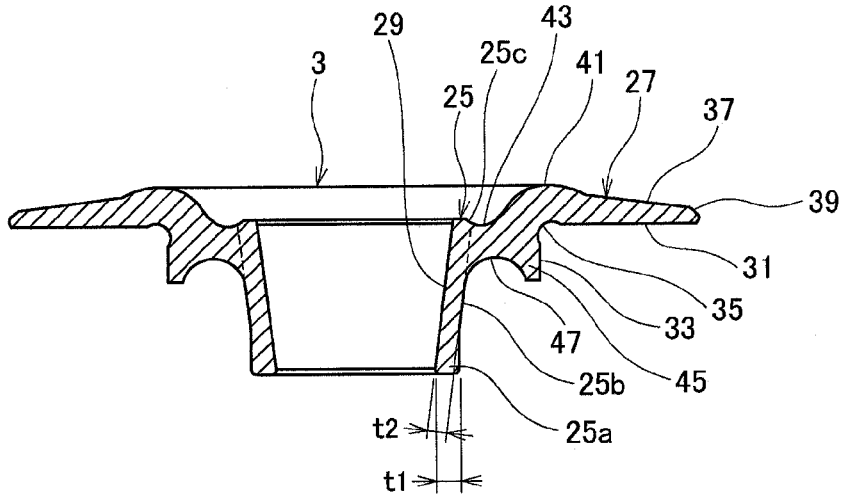

[Fig. 5]
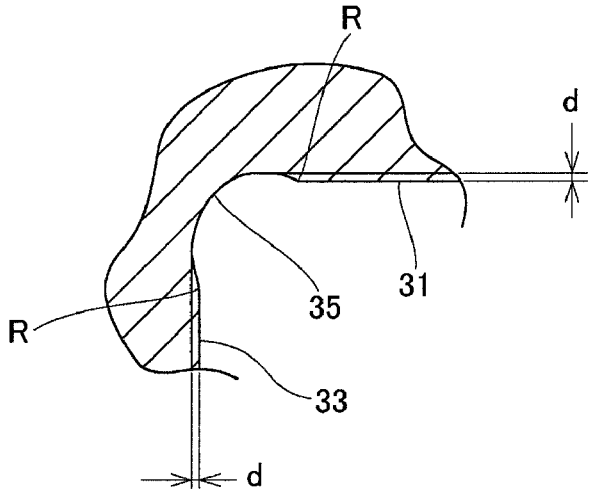
[Fig. 6]
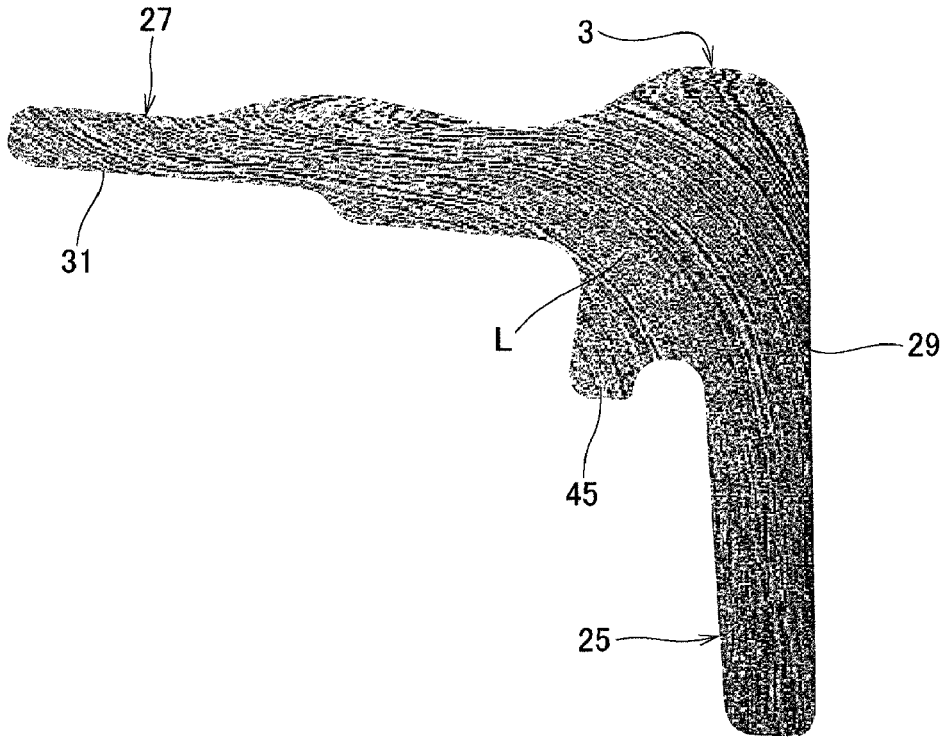

[Fig. 7(a)]
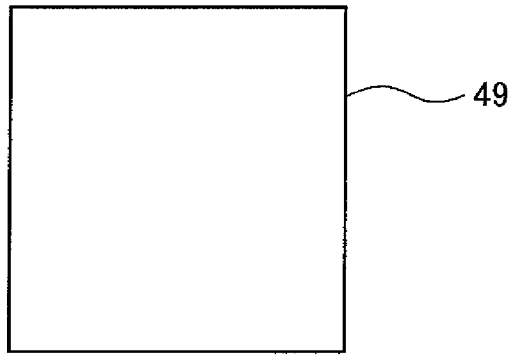
[Fig. 7(b)]
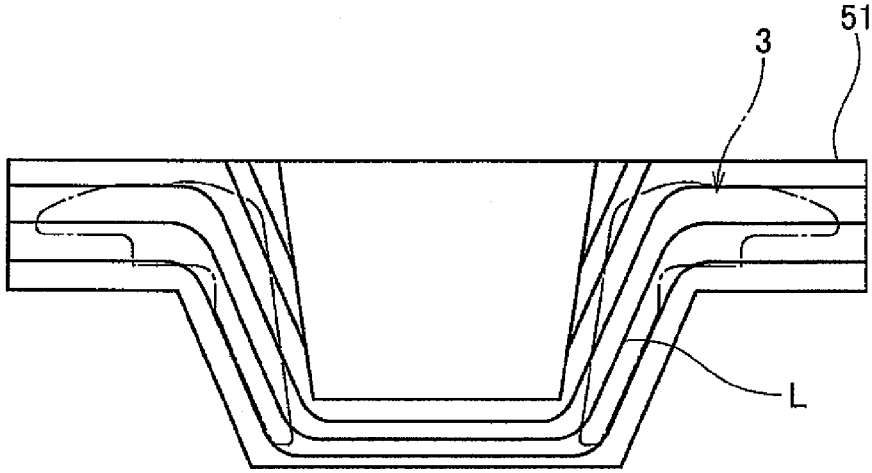

[Fig. 8]
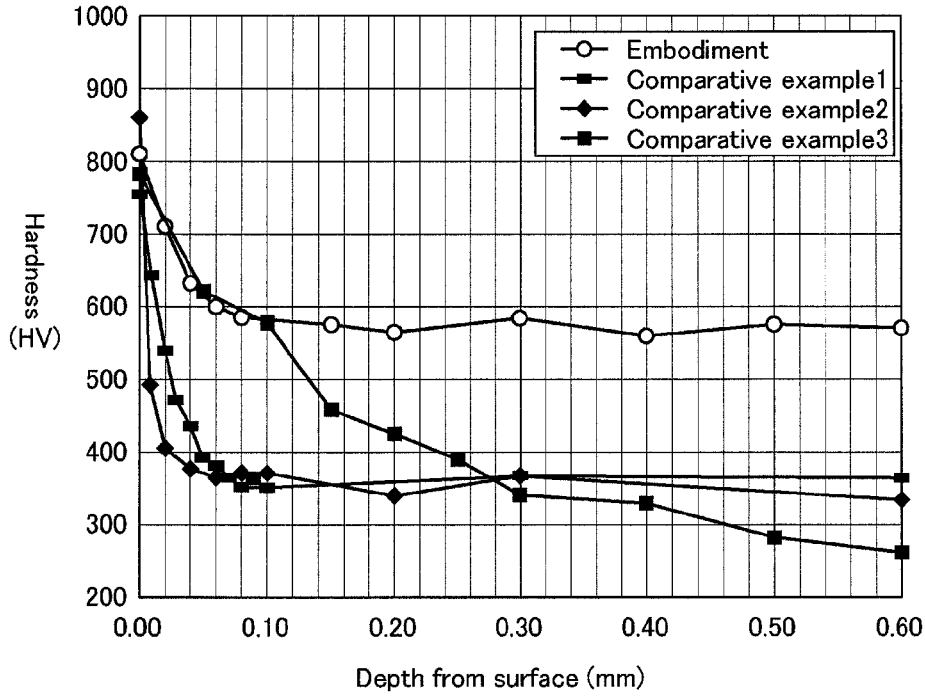
[Fig. 9]
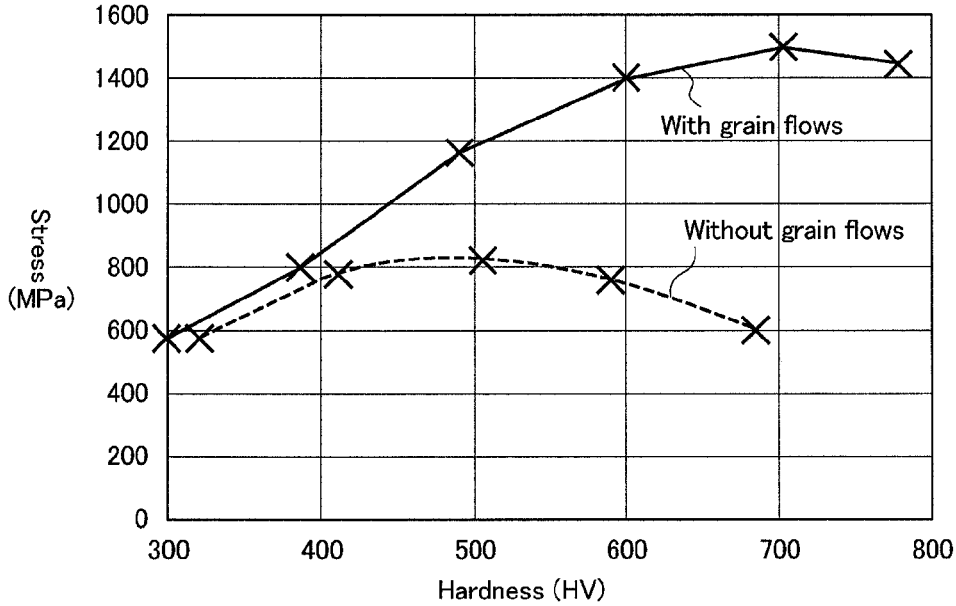

[Fig. 10]
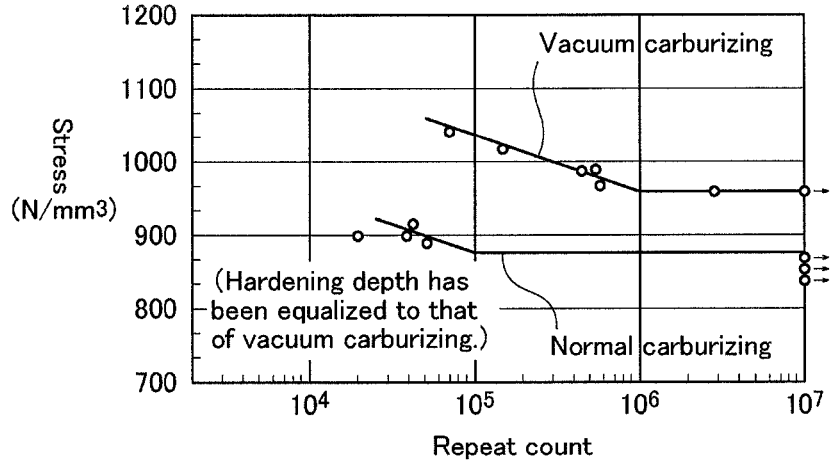
[Fig. 11]
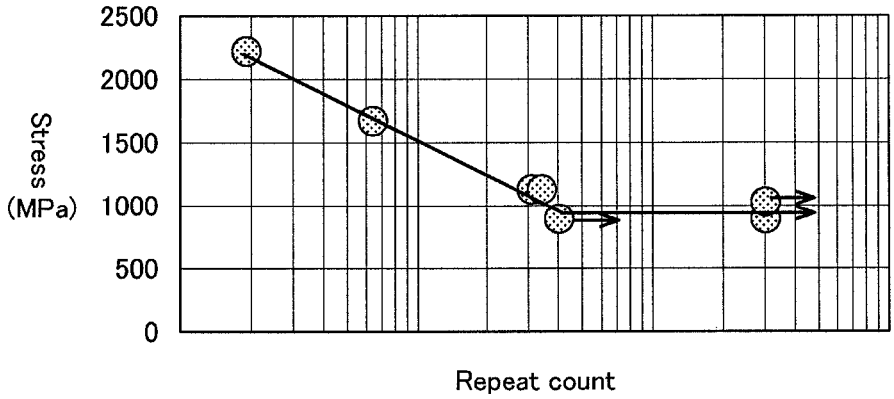
[Fig. 12]
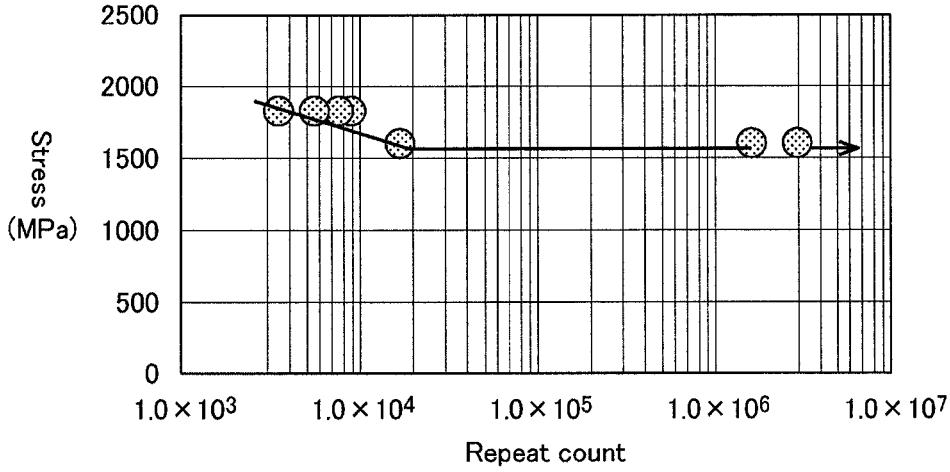

[Fig. 13(a)]
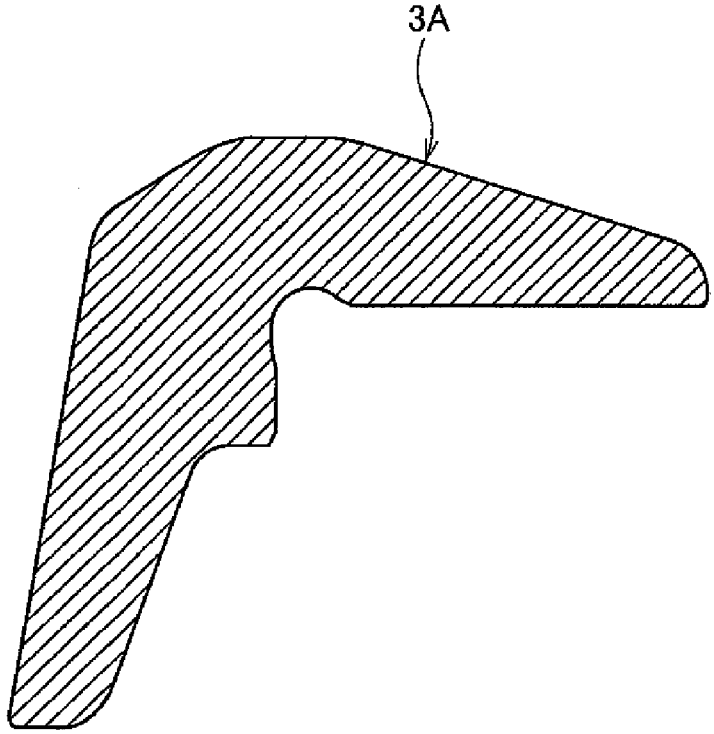
[Fig. 13(b)]
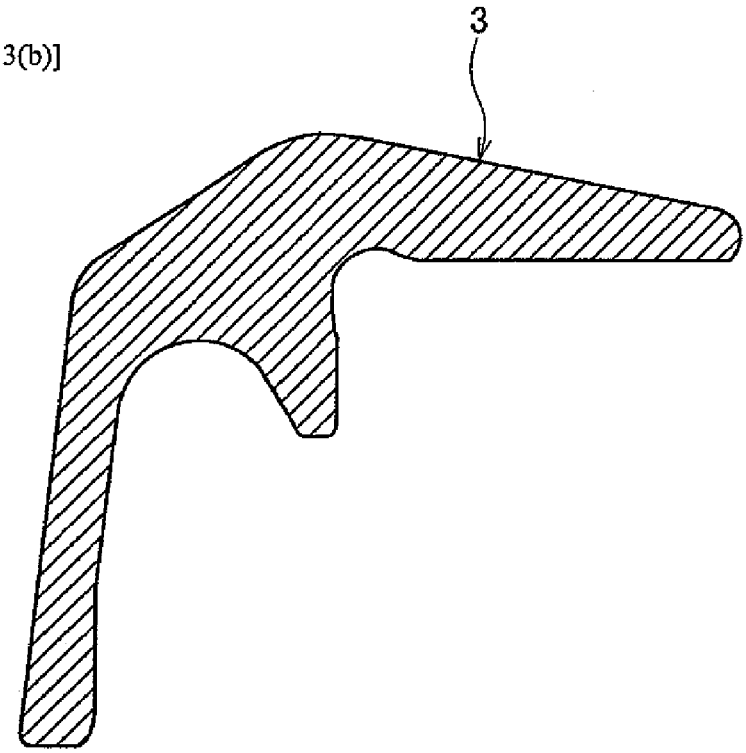

SPRING RETAINER AND SPRING SYSTEM

BACKGROUND OF THE INVENTION

The present invention relates to a spring retainer for supporting a coil spring such as a valve spring and a spring system having a coil spring combined with the spring retainer.

In recent years, valve train systems are light-weighted to increase the output of car engines and decrease the fuel consumption thereof. For this, some retainers are made of aluminum alloys or titanium alloys so as to reduce inertial weight and decrease spring load.

The aluminum- or titanium-alloy spring retainers are expensive, and compared with iron-based ones, have limits on improving strength, thinness and the like.

They, therefore, have a risk of causing a fatigue fracture if the pressing force of a valve spring causes stress concentration on a spring seat base of the spring retainers.

The spring retainer has a tapered support hole in which a cotter is placed to support the spring retainer with a valve stem. If a strong shock is applied to the valve stem, large force will be applied to the support hole to cause a fracture.

The aluminum- or titanium-alloy spring retainer is structured to support a valve spring made of spring steel, and therefore, has a limit on improving abrasion resistance.

To deal with the problems, there have been proposed a light-metal spring retainer in which abrasion resistive particles are embedded into a surface layer thereof and a light-metal spring retainer whose tapered support hole has a lining made of an iron-based sleeve.

Each of them, however, increases the number of materials or parts, to complicate manufacturing or parts management.

Patent Literature 1: Japanese Unexamined Patent Application Publication No. H07-63020

Patent Literature 2: Japanese Unexamined Patent Application Publication No. 2000-161029

Patent Literature 3: Japanese Unexamined Patent Application Publication No. H06-307212

SUMMARY OF THE INVENTION

Problems to be solved by the invention are that the light-metal spring retainers have limits on improving strength, reducing thickness, and increasing abrasion resistance and that the light-metal spring retainers embedding abrasion resistive particles in a surface layer or having an iron-based sleeve as a lining of the tapered support hole increase the number of materials or parts to complicate manufacturing or parts management.

The present invention reduces the thickness and weight of a spring retainer manufactured from an iron-based material that improves the strength and abrasion resistance of the spring retainer. The spring retainer has a retainer body having a support hole to be supported with a shaft and a flange-like spring seat circumferentially formed on a periphery at an axial one side of the retainer body to receive and support a coil spring. The retainer body and spring seat are integrally formed from resilient metal with grain flows continuously formed from the retainer body to the spring seat.

The spring retainer according to the present invention has the retainer body having the support hole to be supported with a shaft and the flange-like spring seat circumferentially formed on a periphery at an axial one side of the retainer body. The retainer body and spring seat are integrally formed from an iron-based material with grain flows continuously formed from the retainer body to the spring seat.

BRIEF DESCRIPTION OF DRAWINGS

[FIG. 1] It is a sectional view illustrating a spring system applied to a valve train system in a car engine. (Embodiment 1)

[FIG. 2] It is a sectional view illustrating an essential part of the spring system applied to the valve train system in the car engine. (Embodiment 1)

[FIG. 3] It is an enlarged sectional view illustrating an essential part of the spring system applied to the valve train system in the car engine. (Embodiment 1)

[FIG. 4] It is a sectional view precisely illustrating the shape of a spring retainer. (Embodiment 1)

[FIG. 5] It is an enlarged sectional view illustrating a recess. (Embodiment 1)

[FIG. 6] It is a sectional view illustrating grain flows in an essential part of the spring retainer. (Embodiment 1)

[FIG. 7] (*a*) is a front view illustrating a material block and (*b*) is an explanatory view illustrating formation of grain flows created by hot forging. (Embodiment 1)

[FIG. 8] It is a graph illustrating changes in surface hardness and inner hardness with respect to depth. (Embodiment 1)

[FIG. 9] It is a graph of comparison in bending fatigue strength between a continuous grain flow case (with grain flows) and a no grain flow case (without grain flows). (Embodiment 1)

[FIG. 10] It is a graph illustrating bending fatigue strength of spring retainers made from SNMC420H and processed by vacuum carburizing and by normal carburizing. (Comparative example)

[FIG. 11] It is a graph illustrating bending fatigue strength of a spring retainer made from a titanium alloy. (Comparative example)

[FIG. 12] It is a graph illustrating bending fatigue strength of the spring retainer. (Embodiment 1)

[FIG. 13] (*a*) is a sectional view illustrating an essential part of a lightweight spring retainer made from a titanium alloy and (*b*) is a sectional view illustrating an essential part of the spring retainer having the same performance and made from spring steel with continuous grain flows. (Embodiment 1)

The spring retainer made from the iron-based material improves strength and abrasion resistance. Even if the pressing force of a coil spring causes stress concentration on a base of the spring seat, the continuous grain flows prevent a fatigue fracture. As a result, the spring retainer can reduce the thickness and weight thereof.

DETAILED DESCRIPTION OF THE INVENTION

An object to make a spring retainer from an iron-based material, improve the strength and abrasion resistance of the spring retainer, and make the spring retainer thin and light is realized by grain flows.

Embodiment 1

[Spring System]

FIG. 1 is a sectional view illustrating a spring system applied to a valve train system in a car engine, FIG. 2 is a sectional view illustrating an essential part thereof, and FIG. 3 is an enlarged sectional view illustrating the essential part.

As illustrated in FIGS. 1 to 3, the spring system 1 has a spring retainer 3 and is supported with a collet 7 at an axial end of an iron-based valve stem 5 as a shaft.

On a tip end of the valve stem 5, a tappet 11 is mounted through a shim 9 to contact with a cam 15 of a cam shaft 13. The spring retainer 3 is in contact with an end of a valve spring 17 that is a coil spring. The other end of the valve spring 17 is in contact with and supported by a spring seat 19 on an engine side.

Between the spring retainer 3 and the spring seat 19, the valve spring 17 creates resiliency to push the front end of the valve stem 5 to the cam 15, so that the valve stem 5 follows the cam 15 due to the resiliency of the valve spring 17, to open and close a valve seat 27 with a valve 21.

[Spring Retainer]

FIG. 4 is a sectional view precisely illustrating the shape of the spring retainer.

As illustrated in FIG. 4, the spring retainer 3 is integrally formed from one of, for example, spring steel, dies steel, bearing steel, and tool steel that are iron-based materials. The spring retainer 3 has a circumferential retainer body 25 and a spring seat 27.

The retainer body 25 has a tapered support hole 29 that is supported through the collet 7 by the axial end of the valve stem 5. A second side end 25*a* of the retainer body 25 has a thickness t1 that is thicker than a thickness t2 (t1>t2) of an intermediate part 25*b* between the second side end 25*a* and the spring seat 27.

The spring seat 27 is formed on a periphery of an axial first side 25*c* of the retainer body 25 and has a flange shape to receive and support the valve spring 17. The spring seat 27 has a circumferential seat face 31 extending in a diametrical direction and an inner contact face 33 extending in an axial direction.

Between the seat face 31 and inner contact face 33 of the spring seat 27, a recess 35 is formed to avoid an interference with an inner diameter side of the coil spring 17. The details of the recess 35 will be explained later.

A surface 37 of the spring seat 27 gradually descends toward the periphery thereof in an axial direction of the support hole 29 assumed to be a top-bottom direction. The periphery of the surface 37 has a chamfered portion 39. An inner circumferential side of the surface 37 is continuous through a circular-arc shoulder 41 and a first circular-arc constriction 43 to the end of the first side 25*c* of the retainer body 25. An inner contact 45 having the inner contact face 33 is continuous through a second circular-arc constriction 47, which positionally corresponds to the first constriction 43 in a diametrical direction, to the intermediate part 25*b* of the retainer body 25.

Every corner is rounded.

FIG. 5 is an enlarged sectional view illustrating the details of the recess.

As illustrated in FIG. 5, the recess 35 is formed in a circular-arc shape between the seat face 31 and the inner contact face 33 and has a depth d from the seat face 31 and inner contact face 33. The recess 35 is continuous through rounded faces to the seat face 31 and inner contact face 33.

[Grain Flow]

FIG. 6 is a sectional view illustrating grain flows in the spring retainer, FIG. 7(*a*) is a front view illustrating a material block, and FIG. 7(*b*) is an explanatory view illustrating formation of grain flows by hot forging.

As illustrated in FIG. 6, the spring retainer 3 has grain flows L that continue from the retainer body 25 to the spring seat 27.

The grain flows L are formed by hot-forging one of spring steel, dies steel, bearing steel, and tool steel that are iron-based materials into the spring retainer 3.

When the material block 49 is hot-forged, grain flows L are continuously formed allover a formed product 51, as illustrated in FIG. 7. Producing the spring retainer 3 by hot forging results in forming the continuous grain flows L illustrated in FIG. 6.

[Hardness and Others]

According to the embodiment, the spring retainer 3 is formed, is quenched, and is tempered, so that the retainer body 25 and spring seat 27 have a surface hardness of Hv650 to 1000 and an inner hardness of Hv450 to 700. The "inner" means a part except the surface having a depth of, for example, 0.1 to 0.6 mm.

FIG. 8 is a graph illustrating changes in surface hardness and inner hardness with respect to depth. The graph of FIG. 8 illustrates the embodiment and comparative examples 1 to 3. The hardness change of the embodiment is of the spring retainer having continuous grain flows. The hardness change of the comparative example 1 is of a spring retainer made of a titanium alloy processed by surface-hardening, that of the comparative example 2 is of a spring retainer made of a titanium alloy processed by oxidizing, and that of the comparative example 3 is of a spring retainer made of SCM435.

As illustrated in FIG. 8, the embodiment is able to set a surface hardness of Hv650 or over that exceeds the hardness of the valve spring 17 of Hv600, thereby improving the abrasion resistance of the seat face 31 and inner contact face 33 with respect to the valve spring 17.

The inner hardness of the retainer body 25 and spring seat 27 is set to Hv590.

FIG. 9 is a graph of a bending fatigue strength comparison between a continuous grain flow case (with grain flows) and a no grain flow case (without grain flows).

As illustrated in FIG. 9, if there are no grain flows, the fatigue strength decreases from a peak of about Hv450. According to the embodiment with continuous grain flows, the fatigue strength increases from an inflection point of about Hv400 to Hv700, to improve the bending fatigue strength in the range of Hv450 to 700.

FIGS. 10 to 12 are graphs illustrating bending fatigue strength, in which FIG. 10 is a graph illustrating bending fatigue strength of spring retainers made from SNMC420H and processed by vacuum carburizing and normal carburizing, FIG. 11 is a graph illustrating bending fatigue strength of a spring retainer made from a titanium alloy, and FIG. 12 is a graph illustrating bending fatigue strength of the spring retainer of the embodiment.

Compared with the fatigue strength (around 900 MPa) of the spring retainers made from SNMC420H and processed by vacuum carburizing and normal carburizing of FIG. 10 and the spring retainer made from a titanium alloy, the bending fatigue strength (1600 MPa) of the spring retainer of the embodiment of the present invention illustrated in FIG. 12 is remarkably higher.

The surfaces of the retainer body 25 and spring seat 27 are set to have a compressive residual stress of −200 to −2000 MPa by, for example, shot peening to improve durability.

[Weight Reduction]

FIG. 13(*a*) is a sectional view illustrating an essential part of a lightweight spring retainer made from a titanium alloy and (*b*) is a sectional view illustrating an essential part of the spring retainer of the embodiment having the same performance and made from spring steel with continuous grain flows.

As illustrated in FIGS. 13(*a*) and (*b*), the spring retainer 3 of the embodiment is, compared with the lightweight spring retainer 3A made of a titanium alloy, maintains bending fatigue strength and abrasion resistance, minimizes useless thickness, and reduces weight.

[Effect of Embodiment]

The spring retainer 3 according to the embodiment has the retainer body 25 having the tapered support hole 29 supported by the valve stem 5 and the flange-like spring seat 27 circumferentially formed on a periphery at the first side 25*c* of the retainer body 25, to receive and support the valve spring 17. The retainer body 25 and spring seat 27 are integrally made from any one of the spring steel, dies steel, bearing steel, and tool steel, so that continuous grain flows are formed from the retainer body 25 to the spring seat 27.

Manufactured from one of the spring steel, dies steel, bearing steel, and tool steel, the spring retainer 3 improves strength and abrasion resistance. Even when the pressing force of the valve spring 17 causes stress concentration on a base of the spring seat 27, it resists against a fatigue fracture according to the continuity of the grain flows. As a result, the spring retainer 3 as a whole can be made thin and lightweight.

The retainer body 25 and spring seat 27 are able to be set to have an inner hardness of Hv450 to 700 to improve bending fatigue strength within this range.

The retainer body 25 and spring seat 27 are set to have a surface hardness that exceeds the hardness of the valve spring 17.

This results in improving the abrasion resistance of the spring retainer 3 with respect to the valve spring 17 made of spring steel.

The surfaces of the retainer body 25 and spring seat 27 are set to have a compressive residual stress of −200 to −2000 MPa.

This results in improving the durability of the spring retainer.

The spring seat 27 is provided with the recess 35 to avoid an interference with the inner diameter side of the valve spring 17.

This suppresses abrasion of this part due to an interference with the valve spring 17, thereby preventing a fracture from occurring between the retainer body 25 and the spring seat 27 due to the abrasion.

The retainer body 25 has the thickness t1 at the second side end 25*a* that is thicker than the thickness t2 of the intermediate part 25*b* between the second side end 25*a* and the spring seat 27.

This prevents a fracture from occurring from the second side end 25*a* when the tapered support hole 29 of the spring retainer 3 receives a strong shock or repetitive load from the valve stem 5 through the cotter 7.

[Others]

The spring system of the present invention is applicable not only to valve train systems of car engines but also to other mechanisms.

The invention claimed is:

1. A spring retainer comprising:

a retainer body having a support hole to be supported with a shaft, the support hole passing through the retainer body so that the support hole extends between opposite first and second ends of the retainer body in an axial direction of the shaft; and a flange-like spring seat circumferentially formed on a periphery at an axial one side of the retainer body proximal to said first end to receive and support a coil spring; wherein the retainer body and spring seat are integrally formed from an iron-based material, and grain flows are continuous from the second end of the retainer body to the spring seat at said periphery;

the retainer body and spring seat have an inner hardness of Hv450 to 700 and a surface hardness that exceeds the hardness of the coil spring; and surfaces of the retainer body and spring seat have a compressive residual stress of −200 to −2000 MPa.

2. The spring retainer as set forth in claim 1, wherein the iron-based material is any one of spring steel, dies steel, bearing steel, and tool steel.

3. The spring retainer as set forth in claim 1, wherein the retainer body and spring seat are integrally formed by hot forging.

4. The spring retainer as set forth in claim 1, wherein the spring seat is provided with a recess to avoid an interference with an inner diameter side of the coil spring.

5. The spring retainer as set forth in claim 1, wherein the thickness of a second side of the retainer body is thicker than the thickness of a part between the second side and the spring seat.

6. The spring retainer as set forth in claim 1, wherein the support hole of the retainer body supports an end of a stem of a valve in an engine valve train system, and the spring seat receives and supports a valve spring of the engine valve train system.

7. A spring system comprising the spring retainer as set forth in claim 1 and a coil spring.

* * * * *